US005960695A

United States Patent [19]

Aardema et al.

[11] Patent Number: 5,960,695

[45] Date of Patent: Oct. 5, 1999

[54] SYSTEM AND METHOD FOR CONTROLLING AN INDEPENDENT METERING VALVE

[75] Inventors: James A. Aardema, Plainfield; Douglas W. Koehler, Naperville, both of Ill.

[73] Assignee: Caterpillar Inc., Peoria, Ill.

[21] Appl. No.: 08/845,337

[22] Filed: Apr. 25, 1997

[51] Int. Cl.[6] ..... F15B 13/044; F15B 13/08

[52] U.S. Cl. ..... 91/433; 91/454; 91/459; 137/596.17

[58] Field of Search ..... 91/433, 454, 459; 137/596.17

[56] References Cited

U.S. PATENT DOCUMENTS 4,970,941 11/1990 Reinhardt ..... 91/433

5,261,234 11/1993 Holloway et al. ..... 91/433 X 5,678,470 10/1997 Koehler et al. ..... 91/459 X 5,701,793 12/1997 Gardner et al. ..... 91/459 X

*Primary Examiner*—Gerald A. Michalsky

*Attorney, Agent, or Firm*—Calvin E. Glastetter

[57] ABSTRACT

A system and method for controlling an independent metering valve operating in a hydraulic circuit determines a displacement command for one or more metering valves to provide desired flows through the metering valves and desired pressure drops across the metering valves. The system determines the displacement command based on a mode of operation of the hydraulic circuit and a velocity for a hydraulic device controlled by the hydraulic circuit. The system determines the displacement command further based on an amount of flow available to the hydraulic circuit. The system allows the hydraulic circuit to be electronically controlled thereby providing flexibility not found in conventional hydraulic control systems.

31 Claims, 8 Drawing Sheets

SYSTEM AND METHOD FOR CONTROLLING AN INDEPENDENT METERING VALVE

TECHNICAL FIELD

The present invention relates generally to hydraulic control valve, and more particularly, to controlling an independent metering valve having one or more independently operable electrohydraulic displacement controlled metering valves.

BACKGROUND ART

Controlling an operation of a hydraulic output device in a hydraulic circuit is conventionally accomplished using a single spool type valve. The single spool valve has a series of metering slots which control flows of hydraulic fluid in the hydraulic circuit including a flow from a pump to the hydraulic output device and a flow from the hydraulic output device to a tank. When the hydraulic output device is a hydraulic cylinder, these flows are commonly referred to as pump-to-cylinder flow and cylinder-to-tank flow, respectively.

The metering slots are machined into the stem of the spool valve. With this arrangement, slot timing and modulation are fixed. In order to modify the performance of the hydraulic circuit, the stem must be remachined. Furthermore, in order to add additional features to the performance of the hydraulic circuit, an entirely new stem may be required. This makes adding features to or optimizing the performance of the hydraulic circuit expensive and time consuming.

The independent metering valve is comprised of four independently operable, electronically controlled metering valves to control flows within the hydraulic circuit. Two of the metering valves are disposed between the input port and the control ports. The other two metering valves are disposed between the output port and the control ports. Because each of the metering valves is controlled electronically, the performance of the hydraulic circuit can be modified by adjusting a control signal to one or more of the metering valves.

What is needed is a system and method for controlling a conventional metering valve, or more specifically, for controlling an independent metering valve, that allows the performance of a hydraulic circuit to be efficiently modified and optimized without having to remachine conventional stems.

DISCLOSURE OF THE INVENTION

The present invention is a system and method for controlling an independent metering valve. According to the present invention, a controller is used to control one or more independently operable, electronically controlled metering valves operating in a hydraulic circuit. The controller controls each metering valve based on inputs including a mode of operation for the hydraulic circuit, a requested velocity, and an available pump flow. The metering valve may be a spool valve, a poppet valves, or some other type of metering valve. The controller determines a displacement command for the metering valve based on a flow through the metering valve and a pressure drop across the metering valve. The controller may also adjust the displacement command to account for dead band, tolerances, etc., in the metering valve.

The present invention provides the ability to flexibly modify a performance of a hydraulic circuit not previously realized in conventional control of hydraulic circuits. As discussed above, conventional control of hydraulic circuits required stems that had to be machined in order to change performance, add features, etc. The present invention provides increased flexibility by allowing changes in the performance of the hydraulic circuit to be implemented in and controlled by software.

The present invention provides further flexibility in that multiple hydraulic circuits can be controlled simultaneously. The controller can adjust the various metering valves to distribute resources (i.e., flow, pressure, etc.) among the hydraulic circuits to provide graceful degradation or to provide critical hydraulic circuits with adequate resources.

The present invention also provides the ability to standardize parts. Standardized parts, such as the independent metering valve discussed herein, reduce costs, shorten development cycles, improve quality, and improve performance. Thus, a particular embodiment of the present invention can be used to control several different types of hydraulic circuits. For example, the same independent metering valve controlled by the present invention can be used both in a lift circuit and in a tilt circuit for hydraulically positioning a bucket of a front end loader. Furthermore, the independent metering valve can be used across models of the front end loader, eliminating the need to redesign valves and stems for different performance and different machines. Still furthermore, the independent metering valve can be used across product lines including excavators, tractors, trucks, etc.

Further features and advantages of the present invention, as well as the structure and operation of various embodiments of the present invention, are described in detail below with reference to the accompanying drawings.

BRIEF DESCRIPTION OF THE DRAWINGS

The present invention is described with reference to the accompanying drawings. In the drawings, like reference numbers indicate identical or functionally similar elements. Additionally, the left-most digit(s) of a reference number identifies the drawing in which the reference number first appears.

BEST MODE FOR CARRYING OUT THE INVENTION

Example Environment

Figure 1:
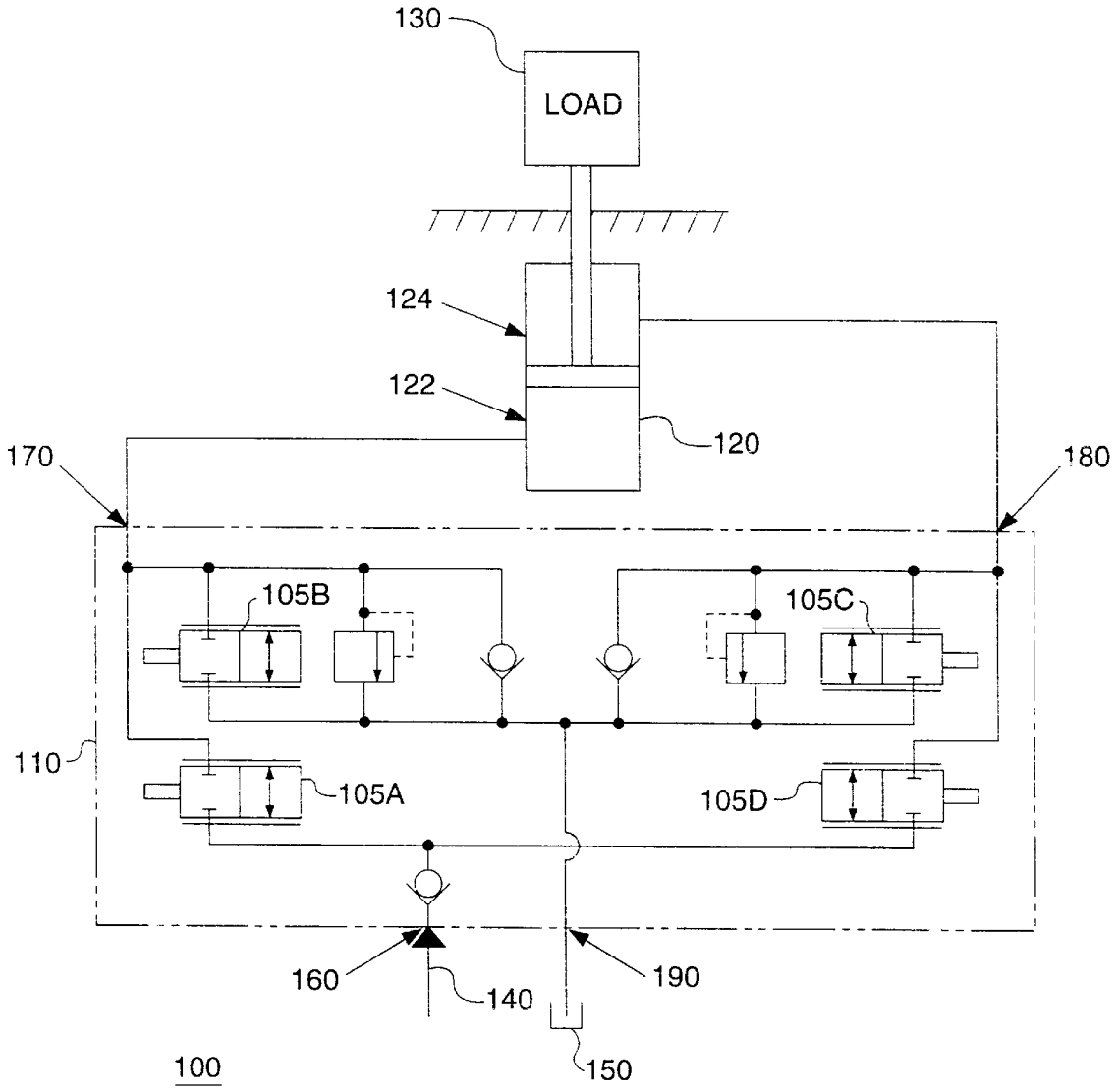
FIG. 1 is a schematic illustration of a hydraulic circuit that is to be controlled by the present invention.

The present invention is now described in terms of an example environment as shown in FIG. 1. In particular, the present invention is described in terms of a hydraulic circuit 100 comprised of an independent metering valve 110 and a hydraulic cylinder 120 having a head end 122 and a rod end 124. Independent metering valve 110 includes an input port 160, an output port 190, and two controls ports 170, 180 (referred to individually as head end control port 170 and rod end control port 180). Independent metering valve 110 further includes four independently operable, electronically controlled metering valves 105 to control fluid flow between a pump 140 and hydraulic cylinder 120 and between hydraulic cylinder 120 and a tank 150. Metering valves 105 may be spool valves, poppet valves, or some other type of metering valve as would be apparent. Metering valves 105 are referred to individually as a pump-to-cylinder head end (PCHE) metering valve 105A, a cylinder-to-tank head end (CTHE) metering valve 1052, a cylinder-to-tank rod end (CTRE) metering valve 105C, and a pump-to-cylinder rod end (PCRE) metering valve 105D as shown in FIG. 1.

The present invention is directed toward controlling each of metering valves 105 in order to flexibly control and optimize the performance of hydraulic circuit 100 in a manner not possible with conventional stems. As would be apparent to one skilled in the art, the present invention applies to other types of hydraulic devices such as hydraulic motors. In addition, the present invention applies to controlling multiple pumps to provide a particular level of flow to one or more hydraulic circuits 100. Further, the present invention applies to hydraulic circuits 100 having a different number of metering valves 105. Still further, the present invention also applies to other types of metering valves capable of being electronically controlled. Yet still further, the present invention also applies to controlling metering valves 105 having conventional stems. As would be apparent to one skilled in the art, the description of the present invention in terms of hydraulic circuit 100 is done for purposes of illustration only, and by no means is intended to limit the scope of the present invention.

Controlling a Hydraulic Circuit

Figure 2:
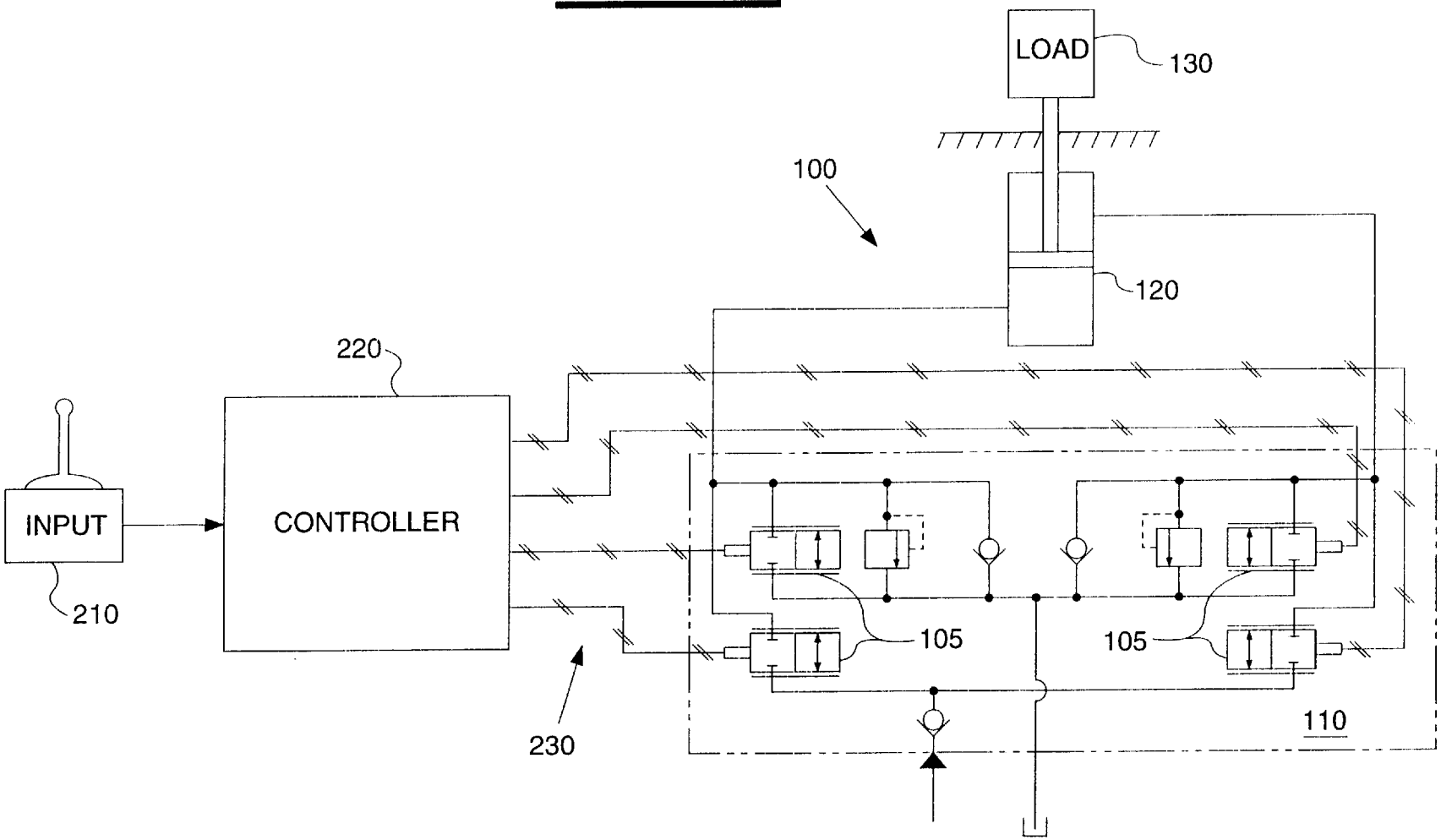
FIG. 2 illustrates a controller according to the present invention for controlling the hydraulic circuit.

FIG. 2 shows a controller 220, according to the present invention, for controlling hydraulic circuit 100. A input device 210 allows an operator to control hydraulic circuit 100. Specifically, input device 210 allows the operator to extend, retract, or maintain a position of hydraulic cylinder 120 connected to a load 130. Input device 210 allows the operator to input a direction command and a velocity command defining a desired motion for hydraulic cylinder 120. In other embodiments of the present invention, input device 210 represents a source of input commands from, for example, a computer used to automatically control the operation of hydraulic cylinder 120 without the operator. Such input commands would be necessary, for example, to control the operation of an autonomous machine. Other inputs may include inputs based on linkage position and/or velocity, pump flow, engine speed, load pressure, etc.

Controller 220 receives the direction and velocity commands and determines an appropriate series of outputs 230 to each of metering valves 105 in independent metering valve 110. In a preferred embodiment of the present invention, outputs 230 represent currents to each of metering valves 105.

Based on commands from input device 210, controller 220 determines a mode of operation for hydraulic circuit 100. Based in part on the mode and the commands from input device 210, controller 220 determines outputs 230 to place each metering valve 105 in an appropriate state. The states of metering valve 105 include open, closed and metering. AOpen@ refers to the state when metering valve 105 is fully open. AClosed@ refers to the state when metering valve 105 is fully closed. AMetering@ refers to the state when metering valve 105 is partially open in proportion to a control signal (shown in FIG. 2 as outputs 230). In the metering state, controller 220 controls an amount of flow through metering valve 105 by adjusting the control signal. The control signal induces a displacement in metering valve 105. The displacement adjusts an aperture, or slot, in metering valve 105 through which fluid passes.

Table I summarizes the states of metering valves 105 for various modes of operation of hydraulic circuit 100. In addition to the modes of operation listed in Table I, the present invention contemplates various other modes of operation including failure modes of operation, high flow modes of operation, pressure limiting modes of operation, etc.

TABLE I

| | Modes of Circuit Operation | | | |
|---|---|---|---|---|
| Mode | PCHE Valve | CTHE Valve | CTRE Valve | PCRE Valve |
| Neutral | Closed | Closed | Closed | Closed |
| Extend Resistive Load | Metering | Closed | Metering | Closed |
| Extend Resistive Load Regeneration | Metering | Closed | Closed | Metering |
| Extend Over Running Load | Metering | Closed | Metering | Closed |
| Extend Over Running Load Regeneration | Metering | Closed | Closed | Metering |
| Extend Over Running Load Quick Drop | Metering | Metering | Metering | Closed |
| Retract Resistive Load | Closed | Metering | Closed | Metering |
| Retract Over Running Load | Closed | Metering | Closed | Metering |
| Retract Over Running Load Quick Drop | Closed | Metering | Metering | Metering |
| Float | Closed | Open | Open | Closed |

Controller Implementation

Figure 7:
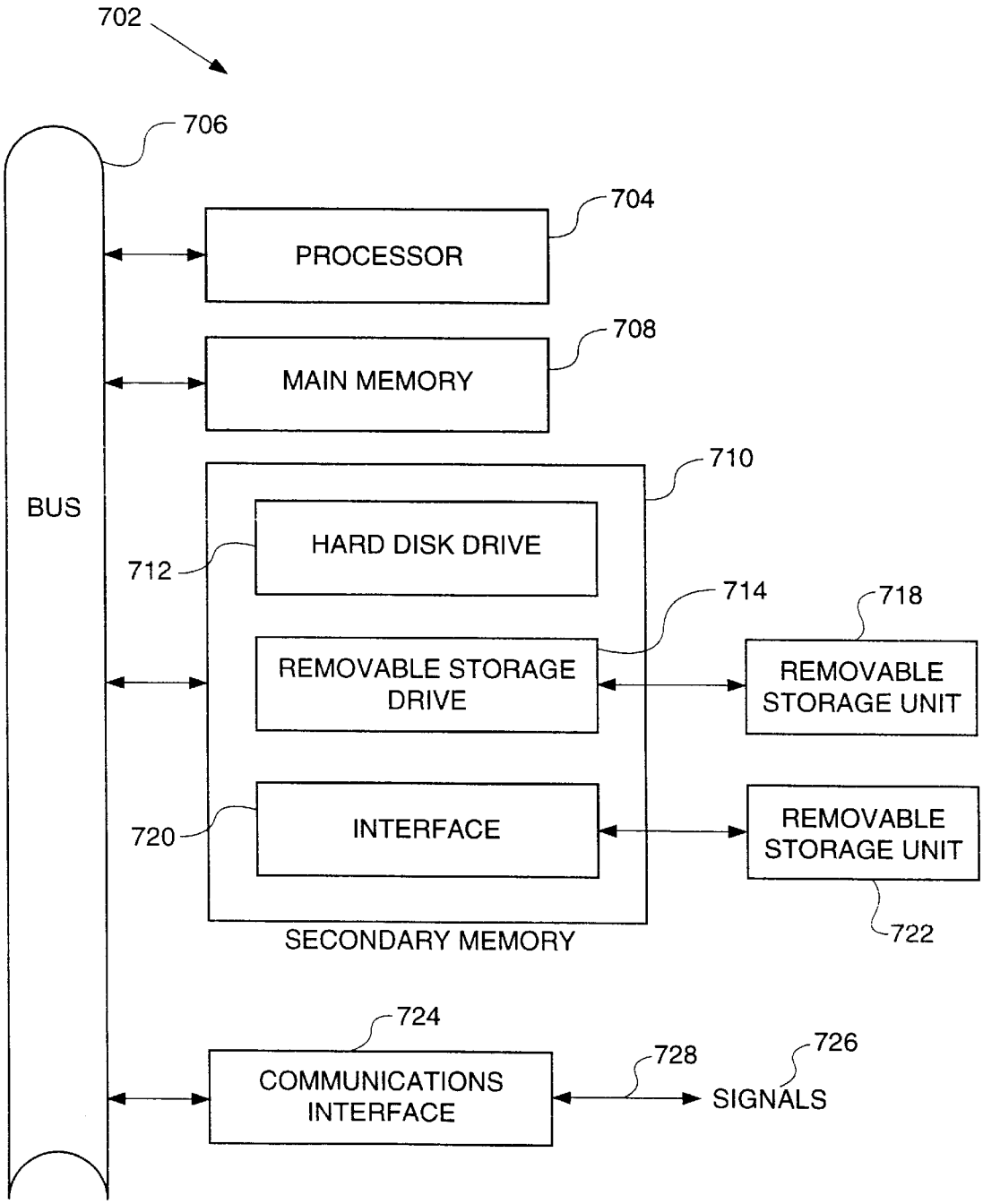
FIG. 7 illustrates an example a computer system useful for implementing the controller according to the present invention.

In various embodiments of the present invention, controller 220 is implemented using hardware, software or a combination thereof and may be implemented in a computer system or other processing system. In fact, in one embodiment, the invention is directed toward a computer system capable of carrying out the functionality described herein. An example computer system 702 is shown in FIG. 7. Computer system 702 includes one or more processors, such as processor 704. Processor 704 is connected to a communication bus 706. Various software embodiments are described in terms of this example computer system. After reading this description, it will become apparent to a person skilled in the relevant art how to implement the invention using other computer systems and/or computer architectures.

Computer system 702 also includes a main memory 708, preferably random access memory (RAM), and may also include a secondary memory 710. Secondary memory 710 may include, for example, a hard disk drive 712 and/or a removable storage drive 714, representing a floppy disk drive, a magnetic tape drive, an optical disk drive, etc. Removable storage drive 714 reads from and/or writes to a removable storage unit 718 in a well known manner. Removable storage unit 718, represents a floppy disk, magnetic tape, optical disk, etc. which is read by and written to by removable storage drive 714. As will be appreciated, removable storage unit 718 includes a computer usable storage medium having stored therein computer software and/or data.

In alternative embodiments, secondary memory 710 may include other similar means for allowing computer programs or other instructions to be loaded into computer system 702. Such means can include, for example, a removable storage unit 722 and an interface 720. Examples of such can include a program cartridge and cartridge interface (such as that found in video game devices), a removable memory chip (such as an EPROM, or PROM) and associated socket, and other removable storage units 722 and interfaces 720 which allow software and data to be transferred from the removable storage unit 718 to computer system 702.

Computer system 702 can also include a communications interface 724. Communications interface 724 allows software and data to be transferred between computer system 702 and external devices. Examples of communications interface 724 can include a modem, a network interface (such as an Ethernet card), a communications port, a PCMCIA slot and card, etc. Software and data transferred via communications interface 724 are in the form of signals which can be electronic, electromagnetic, optical or other signals capable of being received by communications interface 724. Signals 726 are provided to communications interface via a channel 728. Channel 728 carries signals 726 and can be implemented using wire or cable, fiber optics, a phone line, a cellular phone link, an RF link and other communications channels.

In this document, the terms Acomputer program medium@ and Acomputer usable medium@ are used to generally refer to media such as removable storage device 718, a hard disk installed in hard disk drive 712, and signals 726. These computer program products are means for providing software to computer system 702.

Computer programs (also called computer control logic) are stored in main memory and/or secondary memory 710. Computer programs can also be received via communications interface 724. Such computer programs, when executed, enable the computer system 702 to perform the features of the present invention as discussed herein. In particular, the computer programs, when executed, enable processor 704 to perform the features of the present invention. Accordingly, such computer programs represent controllers of the computer system 702.

In an embodiment where the invention is implement using software, the software may be stored in a computer program product and loaded into computer system 702 using removable storage drive 714, hard drive 712 or communications interface 724. The control logic (software), when executed by processor 704, causes processor 704 to perform the functions of the invention as described herein.

In another embodiment, the invention is implemented primarily in hardware using, for example, hardware components such as application specific integrated circuits (ASICs). Implementation of the hardware state machine so as to perform the functions described herein will be apparent to persons skilled in the relevant art(s).

In yet another embodiment, the invention is implemented using a combination of both hardware and software.

Controller Operation

Figure 3:
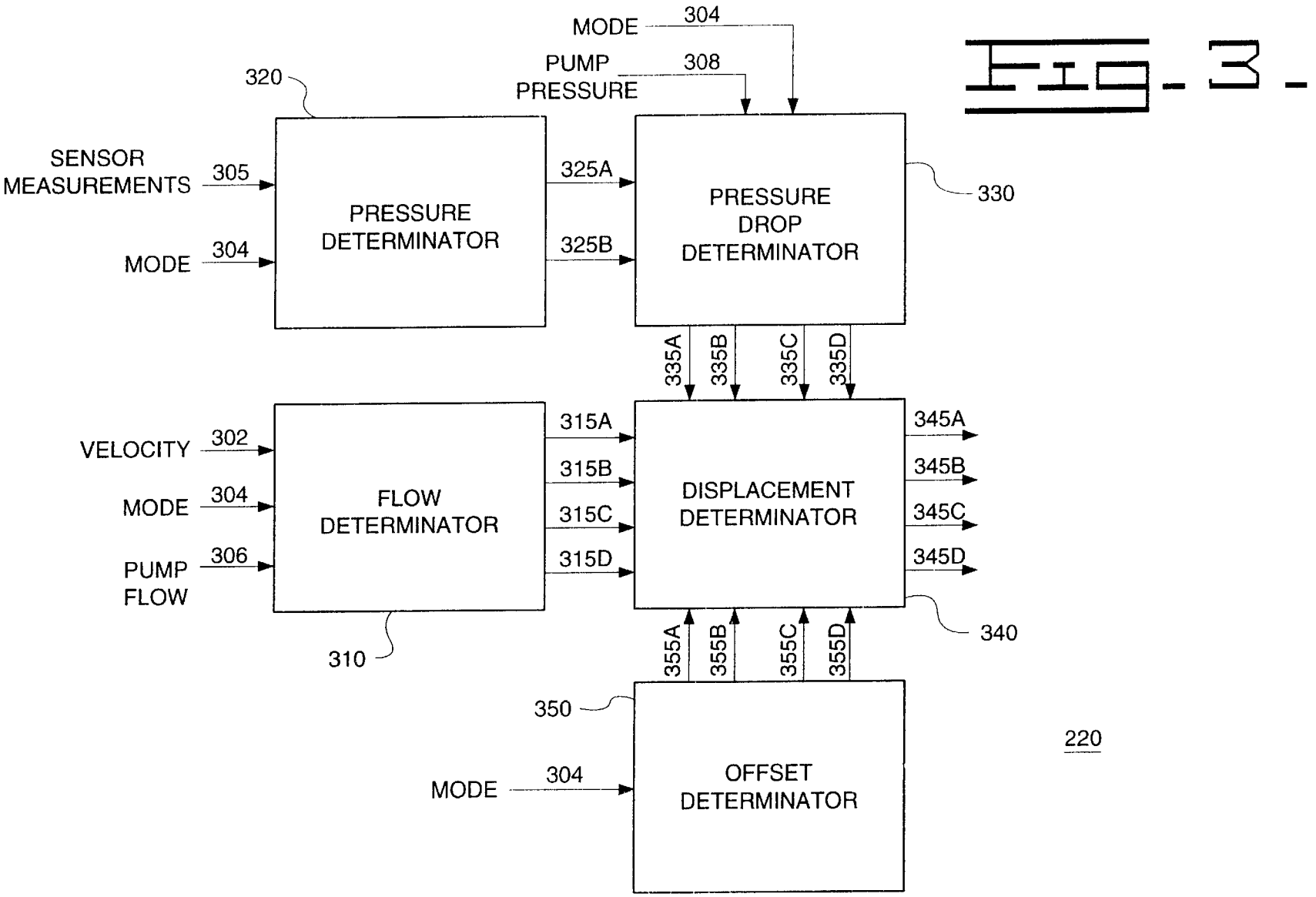
FIG. 3 illustrates the controller according to the present invention in further detail.

FIG. 3 illustrates an operation of controller 220 in further detail. Controller 220 includes a flow determinator 310, a pressure determinator 320, a pressure drop determinator 330, a displacement determinator 340, and an offset determinator 350.

Flow determinator 310 receives a requested velocity 302 from an input source such as input device 210, a mode 304 as determined by controller 220, and a pump flow 306 indicative of an amount of flow available to hydraulic circuit 100. Flow determinator 310 determines flows 315 required through each metering valve 105 so that the velocity of hydraulic cylinder 120 matches velocity 302 in accordance with mode 304 and pump flow 306. Flow determinator 310 is described in further detail below.

Pressure determinator 320 determines various pressures 325 in hydraulic circuit 100. Based on pressures 325, various pressure drops across metering valves 105 can be determined as will be discussed below. Pressure determinator 320 may use actual or estimated pressures in hydraulic circuits. Actual pressures are measured using various pressure sensors located proximately to areas of interest in hydraulic circuit 100. Estimated pressures are obtained from knowledge of the characteristics of hydraulic circuit 100 and the environment in which it operates (i.e., load characteristics, motion dynamics, mode, etc.). Pressure determinator 320 is discussed in further detail below.

Pressure drop determinator 330 determines pressure drops 335 across various components in hydraulic circuit 100, including metering valves 105, based on pressures 325 obtained from pressure determinator 320. Pressure drop determinator 330 determines pressure drops 335 so that proper displacement commands can be determined for metering valves 105. Pressure drop determinator 330 is described in further detail below.

Offset determinator 350 determines an offset command 355 for each of metering valves 105 in hydraulic circuit 100. Offsets 355 are used to bias, or preposition, metering valves to account for dead band, tolerances, leakage, etc. Offset determinator 350 is described in further detail below.

Displacement determinator 340 determines a displacement command for each of metering valves 105 in hydraulic circuit 100. In a preferred embodiment of the present invention, displacement determinator 340 determines displacement commands based on flows 315, pressured drops 335, and offsets 355. Each displacement command corresponds to an actuation signal 345 to metering valve 105 that initiates an appropriate displacement in the valve to provide a desired aperture through which hydraulic fluid may flow. Displacement determinator 340 is described in further detail below.

The controller is described and illustrated herein as operating in an open loop manner. It is contemplated that various sensors and feedback loops may be implemented to provide closed loop control over velocity, flow, pressure, etc., as would be apparent.

Flow Determinator

As discussed above, flow determinator 310 determines flows 315 based on requested velocity 302, mode 304, and pump flow 306. In a preferred embodiment of the present invention, flow determinator 310 determines a PCHE flow 315A through PCHE metering valve 105A, a CTHE flow 315B through CTHE metering valve 105B, a CTRE flow 315C through CTRE metering valve 105C, and a PCRE flow 315D through PCRE metering valve 105D.

Flow determinator 310 determines flows 315, in part, based on pump flow 306. Pump flow 306 represents the amount of flow available to hydraulic circuit 100. Various embodiments of the present invention may have multiple hydraulic circuits 100 that are supplied by the same pump(s) (not shown). The multiple hydraulic circuits 100 may be in a series or a parallel configuration. Each of the multiple hydraulic circuits 100 effects the amount of available pump flow 306 depending on the configuration as would be apparent.

As is known, a velocity 302 of a hydraulic device depends upon flow. Thus, whether velocity 302 is achievable is dependent upon pump flow 306. If an amount of flow required to achieve velocity 302 is less than pump flow 306, flow determinator 310 outputs flows 315 based on velocity 302. If the amount of flow required is more than pump flow 306, flow determinator 310 must reduce flows 315 to accommodate for pump flow 306 thereby requiring a reduced velocity less than velocity 302. This is because flow determinator 310 cannot output more flow than it has available.

Flow determinator 310 determines flows 315 based on velocity 302 according to the following equation:

$$Q=V*A$$

where

Q is flow,

V is velocity, and

A is a cross-sectional area of hydraulic device.

Figure 8:
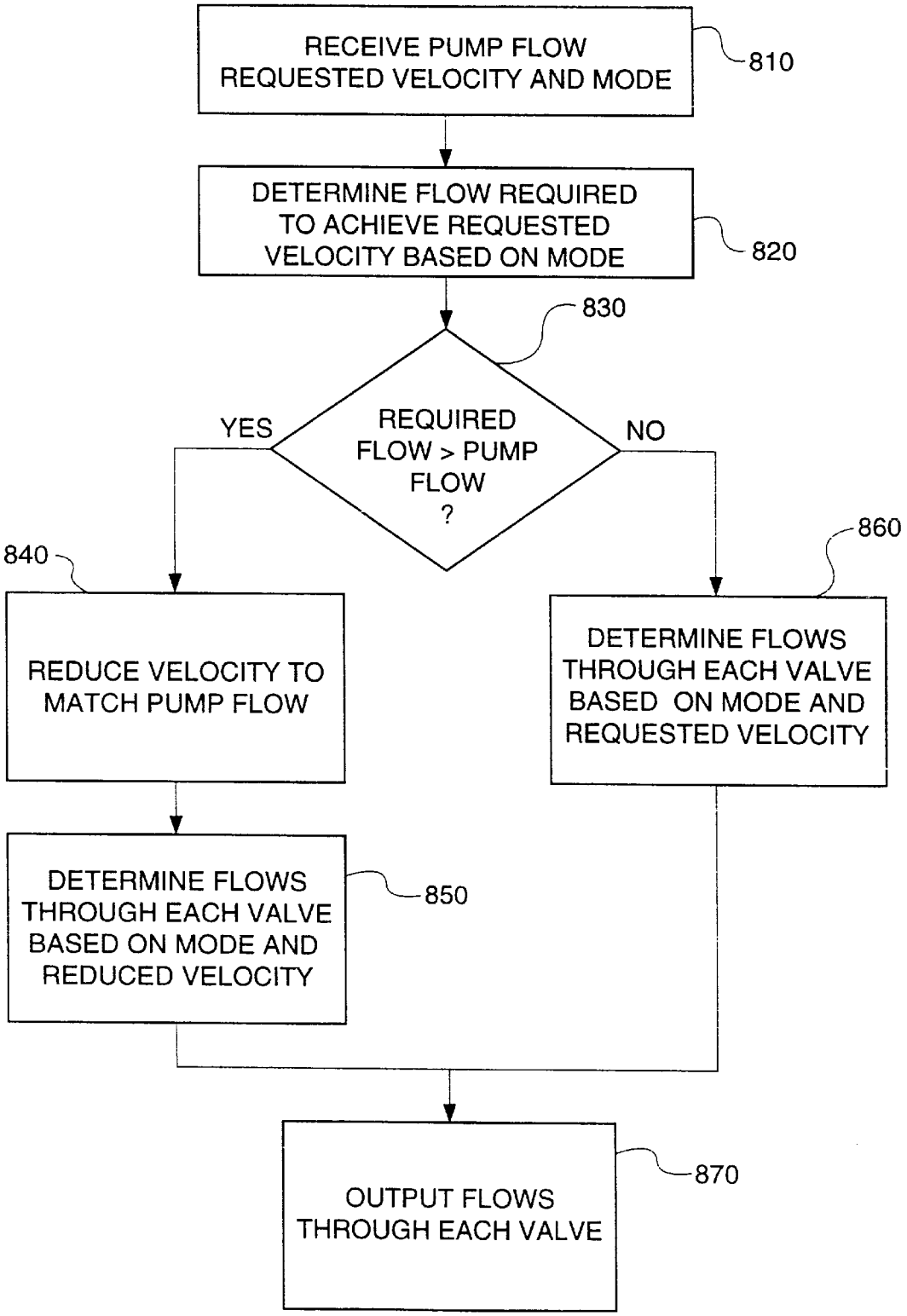
FIG. 8 illustrates an operation of the flow determinator in further detail.

FIG. 8 shows the operation of flow determinator 310 in further detail. In a step 810, flow determinator 310 receives requested velocity 302, mode 304, and pump flow 306. In a step 820, flow determinator 310 determines a required flow through hydraulic circuit 100 required to achieve requested velocity 302 based on mode 304. In a decision step 830, the required flow is compared against pump flow 306 to determined whether enough flow is available to achieve requested velocity 302. If the required flow is greater than pump flow 306 (i.e., not enough flow available to achieve requested velocity 302), in a step 840, a reduced velocity is determined corresponding to pump flow 306. Next in a step 850, flows 315 are determined based on the reduced velocity and mode 304. Processing continues at a step 870.

If the required flow is not greater than pump flow 306 (i.e., enough flow is available to achieve requested velocity 302), in a step 860, flows 315 are determined based on requested velocity and mode 304. Processing continues at step 870.

In step 870, once flows 315 are determined based on either requested velocity 302, or the reduced velocity based on pump flow 306, flows 315 are output to displacement determinator 340.

Pressure Determinator

Pressure determinator 320 determines pressures 325 in hydraulic cylinder 120. In one embodiment of the present invention, pressure determinator 320 determines pressure 325 including cylinder head pressure 325A in head end 122 and cylinder rod pressure 325B in rod end 124. In another embodiment of the present invention, pressure determinator 320 may also determine a pump pressure 308. In yet another embodiment of the present invention, pressure determinator 320 may also determine a hydraulic motor pressure (not shown).

In one embodiment of the present invention, pressure determinator 320 determines pressures 325 based on actual pressures determined from sensor measurements 305 obtained from pressure sensors (not shown) proximate to hydraulic cylinder 120.

In another embodiment of the present invention, pressure determinator 320 estimates pressures 325 based on mode 304 and flows 315. In this embodiment, pressure determinator 320 may also estimate pressures 325 based on load 130 and a pump pressure 308. These parameters are based, in part, on a known operating environment for hydraulic circuit 100. For example, load 130 can be roughly determined based on known characteristics of a machine in which hydraulic circuit 100 operates. Based on load 130 and other characteristics of hydraulic circuit 100, a required pump pressure 308 can be estimated. As would be apparent, these estimates provide a framework for estimating pressures 325.

In a preferred embodiment of the present invention, pressure determinator 320 determines pressures 325 based primarily on sensor measurements 305 from pressure sensors. In this embodiment, pressure determinator 320 also estimates pressures 325 as a backup, in case one or more sensors fail or provide erroneous measurements. This embodiment of the present invention prevents catastrophic failures and permits continued operation until the failed sensor(s) can be replaced.

Pressure Drop Determinator

Pressure drop determinator 330 determines a pressure drop 335 across each of the metering valves 105 based on pressures 325, mode 304 and a pump pressure 308. In a preferred embodiment of the present invention, pressure drop determinator 330 determines a PCHE pressure drop 325A across PCHE metering valve 105A, a CTHE pressure drop 335B across CTHE metering valve 105B, a CTRE pressure drop 335C across CTRE metering valve 105C, and a PCRE pressure drop 335D across PCRE metering valve 105D.

Mode 304 to determine which metering valves 105 are open, closed, or metering. Mode 304, in part, enables pressure drop determinator 330 to determine pressure drop 335 across each metering valve 105. Pressure drop 335 across an open metering valve 105 is set at a value determined by characteristics of hydraulic circuit 100 (including relief valves, etc.) and metering valve 105. This provides a minimum pressure drop across each open metering valve 105. These values are dependent upon a type of metering valve 105 used and mode 304 as would be apparent.

Pressure drop 335 across a closed metering valve 105 is preferably set at a very large or maximum value (e.g., a maximum integer value for controller 220). This coupled with the setting of flow 315 to zero ensures that the closed metering valve will not allow any flow through.

Pressure drop 335 across a Ametering@ metering valve 105 is determined by the difference between the pressures on each side of metering valve 105. For PCHE metering valve 105A, PCHE pressure drop 335A is the difference between pump pressure 308 and cylinder head pressure 325A. For PCRE metering valve 105D, PCRE pressure drop 335D is the difference between pump pressure 308 and cylinder rod pressure 325B. For CTHE metering valve 105B, CTHE pressure drop 335B is the difference between cylinder head pressure 325A and tank pressure, which in a preferred embodiment is assumed to be zero. For CTRE metering valve 105C, CTRE pressure drop 335C is the difference between cylinder rod pressure 325B and tank pressure. Even if the difference between the pressures on each side of the Ametering@ metering valve 105 indicates otherwise, in one embodiment of the present invention, pressure drop 335 may be set to be no less than the minimum value set for the open metering valve 105.

Offset Determinator

Offset determinator 350 determines an offset 355 based on mode 304 to account for effects such as dead band, tolerances, etc. In one embodiment of the present invention, offsets 355 may be used to preposition metering valves 105 in anticipation of motion. In a preferred embodiment of the present invention, offset determinator 350 determines an offset 355A for PCHE metering valve 105A, an offset 355B for CTHE metering valve 105B, an offset 355C for CTRE metering valve 105C, and an offset 355D for PCRE metering valve 105D. In this embodiment of the present invention, offsets 355 are applied to metering valves 105 to account for effects such as dead band, etc. By accounting for such effects, displacement commands can result in an immediate flow through the valve. In some embodiments of the present invention, offsets 355 may not be used or may not be necessary.

In a preferred embodiment of the present invention, three types of offsets 355 are included: a nominal dead band offset, a zero flow offset, and a zero displacement offset. The nominal dead band offset is an amount of displacement in metering valve 105 that nominally accounts for the worst case or actual tolerance in metering valve 105. The nominal dead band offset is specified based on the type of metering valve 105. The zero flow offset is a maximum amount of displacement that guarantees no flow, or minimum leakage, through the valve. The zero flow offset is determined from the nominal dead band less the worst case tolerance or actual tolerance and less some displacement to minimize leakage in metering valve 105. The zero displacement offset ensures that the displacement is zero when metering valve 105 is closed.

In this embodiment of the present invention, offsets 355 are used to preposition metering valves 105 in anticipation of motion. When hydraulic circuit 100 is in a neutral mode, offset determinator 350 sets offsets 355 to the zero displacement offset. In a preferred embodiment of the present invention, input device 210 includes a certain amount of dead band before a throw results in a non-zero requested velocity 302. In particular, for input device 210, a throw in the range of 0 to 20% corresponds to zero requested velocity 302.

Offset determinator 350 operates in two stages in this dead band range of input device 210. In particular, when the throw is in the range of 0 to 10%, offset determinator 350 maintains offsets 355 at the zero displacement offset. The zero displacement offset ensures that metering valve 105 is closed with no flow and little, if any, leakage through metering valve 105. When the throw is in the range of 10% to 20%, offset determinator 350 sets offsets 355 to the zero flow offset in anticipation of motion. At the point when the throw is 10%, hydraulic circuit 100 switches its mode from neutral to some non-neutral mode. At this point, the velocity of hydraulic cylinder 120 remains at zero.

When the throw is in the range of 10% to 20%, a small amount of leakage due to tolerances in the nominal dead band offset flows through metering valve 105. This leakage is tolerated in order to provide immediate flow through metering valve 105 in response to input device 210 indicating a throw beyond the 20% range. When the throw reaches 20%, indicating a requested velocity, offset determinator 350 set offsets 335 to the dead band offset. As would be apparent, other dead band ranges of input device 210 as well as other offsets 355 could be provided.

Displacement Determinator

Displacement determinator 340 determines a displacement command and a corresponding actuation signal 345 for each metering valve 105 based on flows 315, pressure drops 335, and offsets 355. In a preferred embodiment of the present invention, displacement determinator 340 determines an actuation signal 345A for PCHE metering valve 105A, an actuation signal 345B for CTHE metering valve 105B, an actuation signal 345C for CTRE metering valve 105C, and an actuation signal 345D for PCRE metering valve 105D. In a preferred embodiment of the present invention, actuation signals 345 are current signals to be supplied to actuate metering valves 105. As would be apparent, actuation signals 345 may be voltage signals, digital values, pulse-width modulated signals, etc., depending on the particular metering valve 105 employed in hydraulic circuit 100.

Figure 4:
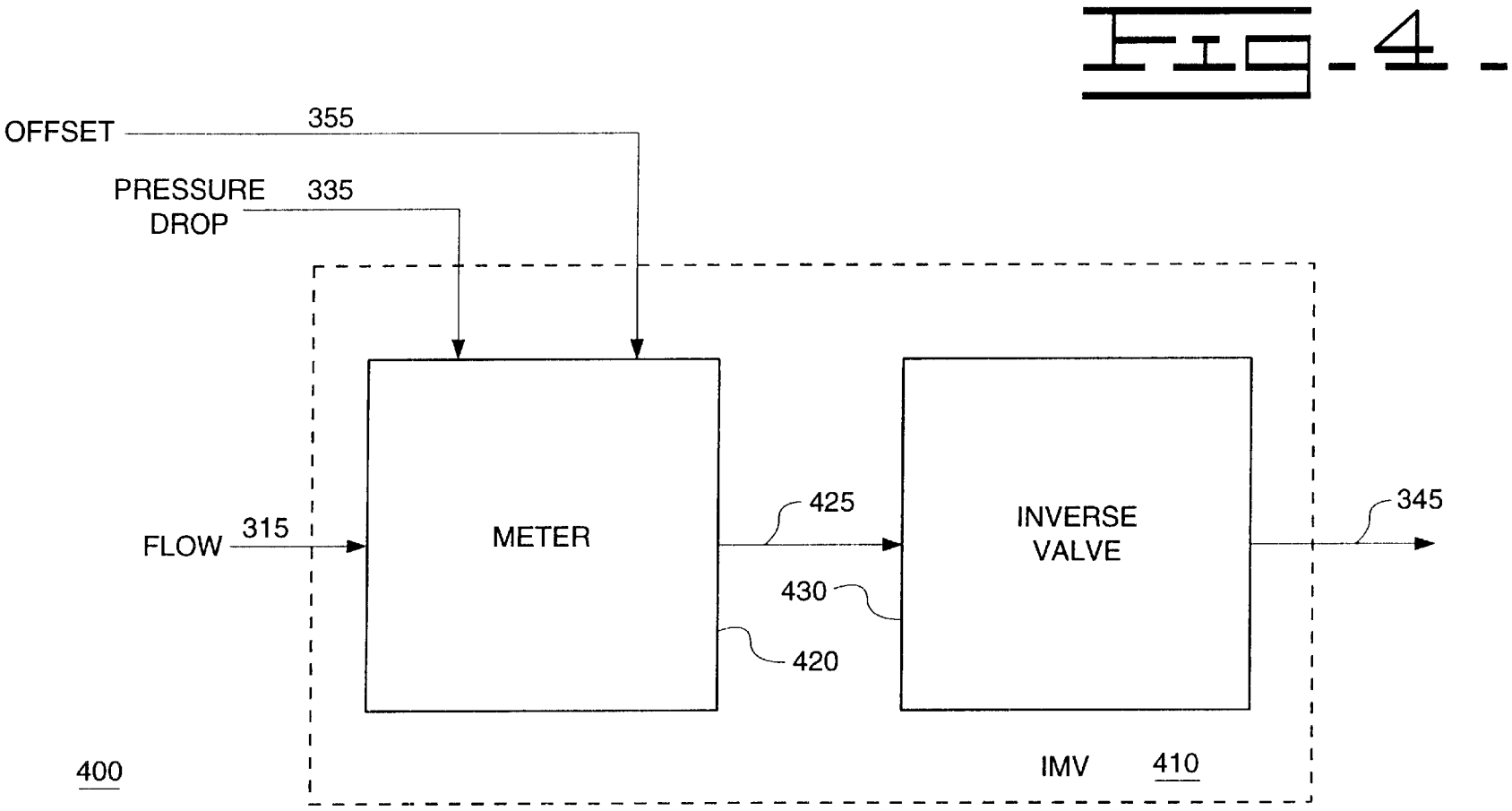
FIG. 4 illustrates a portion of the controller that controls a single metering valve according to the present invention in further detail.

FIG. 4 illustrates the operation of a portion 400 of displacement determinator 340 in further detail. In particular, FIG. 4 illustrates an independent metering valve controller 410 (IMV 410) that controls a single metering valve 105 according to the present invention. In a preferred embodiment of the present invention, displacement determinator 340 includes four IMVs 410, one IMV 410 for each of the four metering valves 105. The operation of a single IMV 410 as it controls a single metering valve 105 is now discussed.

IMV 410 receives flow 315, pressure drop 335, and offset 355 for metering valve 105 as inputs. IMV 410 outputs actuation signal 345 to actuate metering valve 105. As discussed above, in a preferred embodiment of the present invention, actuation signal 345 is a current signal that acts on metering valve 105 to induce/reduce a displacement therein. IMV 410 includes a meter functional block 420 and an inverse valve functional block 430.

Meter block 420 receives flow 315, pressure drop 335, and offset 355 for metering valve 105 and determines a displacement command 425. In a preferred embodiment of the present invention, displacement command 425 represents an amount of distance metering valve 105 must be displaced in order to meet the requisite flow 315, pressure drop 335, and offset 355. Inverse valve block 430 transforms displacement command 425 (a distance) into actuation signal 345 to be applied to metering valve 105. Meter block 420 and inverse valve block 430 are discussed in further detail below with respect to FIG. 5 and FIG. 6.

Meter Block

Figure 5:
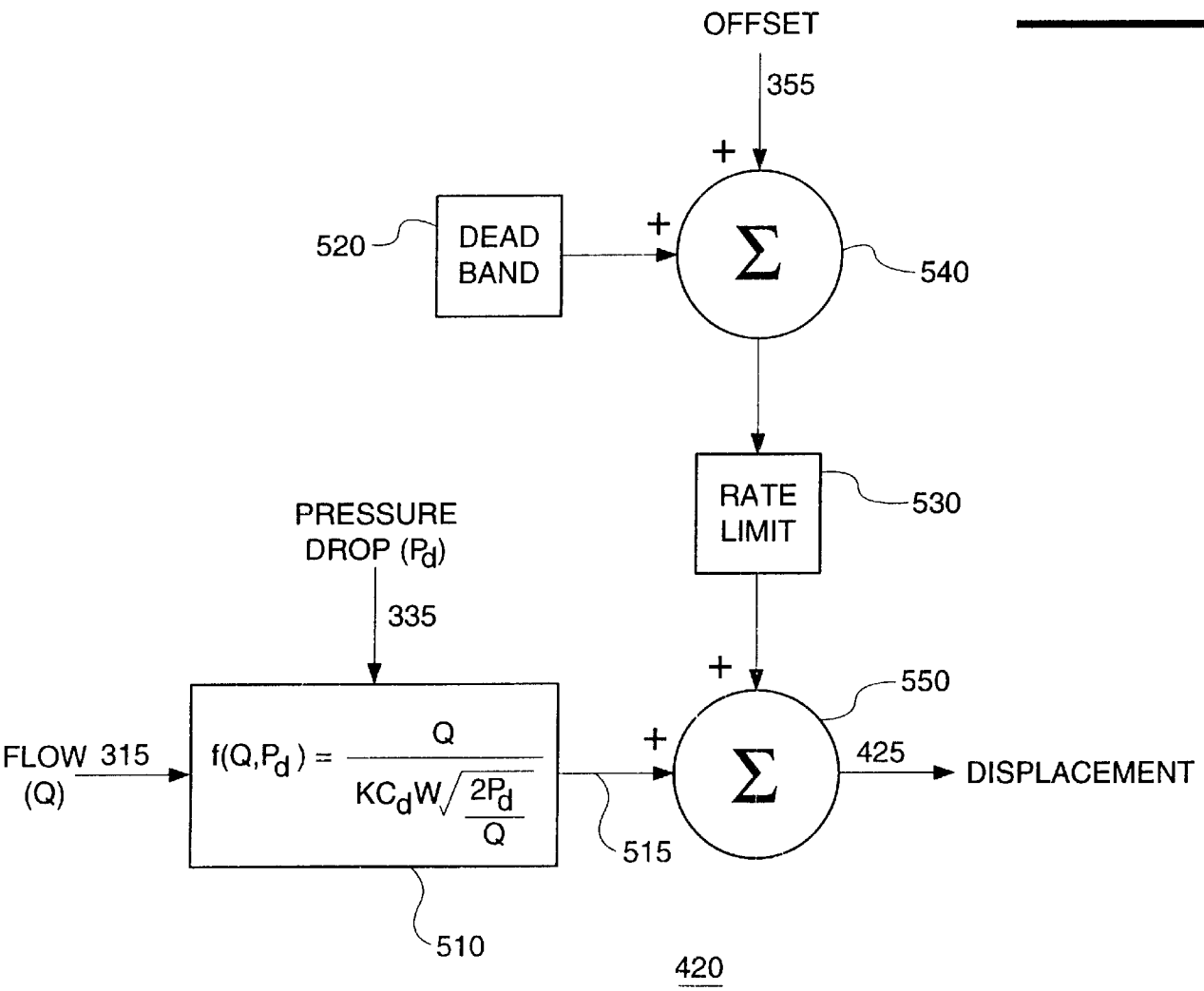
FIG. 5 illustrates a meter portion of the single valve controller according to the present invention in further detail.

FIG. 5 illustrates the operation of meter block 420 in further detail. Meter block 420 includes a conversion operator 510, a nominal dead band 520, a rate limiter 530, a first summing junction 540, and a second summing junction 550.

Conversion operator 510 receives flow 315 and pressure drop 335 and computes a relative displacement 515. In one embodiment of the present invention, relative displacement 515 is determined according to the following equation:

$$f(Q, P_d) = \frac{Q}{K\, C_d\, W \sqrt{\frac{2\, P_d}{\rho}}}$$

where:

Q is flow, $P_d$ is pressure drop, $C_d$ is coefficient of discharge,

W is area gain,

D is fluid density, and

K is a units conversion constant.

Conversion operator 510 determines relative displacement 515 using appropriate values in the above equations based on characteristics of metering valve 105 and hydraulic circuit 100.

In a preferred embodiment of the present invention, relative displacement 515 is determined based on test data recorded in the form of a look-up table or a map as opposed to the above equation. Values of flow and pressure drop are used as indices into the table to determine relative displacement 515 as would be apparent.

By accounting for pressure drop 335, controller 220 can adjust metering valves 105 in a manner not previously achieved. For example, metering valves 105 can be adjusted to not only provide particular flows 315 but also particular pressures 308, 325. Thus, controller 220 can better control hydraulic circuit 100 in conditions of peak demand by providing for graceful degradation or by allocating flow and/or pressure to other more critical hydraulic circuits 100. These objectives can be accomplished, in part, by controlling metering valves 105 according to the present invention.

Summing junction 540 receives offset 355 and a nominal dead band 520 and merely adds the two together. As discussed above, a preferred embodiment of the present invention includes three types of offsets: the nominal dead band offset, the zero flow offset, and the zero displacement offset. The nominal dead band is provided by dead band 520. In a preferred embodiment of the present invention, the nominal dead band is accounted for automatically in meter block 420. Offset 355 accounts for any additional offset to be added with dead band 520. For example, to achieve the zero flow offset, offset 355 is actually a negative value so that when added with dead band 520, the sum accounts for the tolerance in the nominal dead band plus leak length.

Rate limiter 530 receives the output of summing junction 540. Rate limiter 530 reduces an effect of applying a step change in offset 355. Rate limiter 530 acts as to smooth the effect of a change in offset 355. For example, rate limiter 530 may be a first order lowpass filter. As would be apparent, other filters that smooth the effect of changes in offset 355 could be used as well.

Summing junction 550 receives an output from rate limiter 530 and relative displacement 515 from conversion operator 510 and merely adds the two together to form an absolute displacement command 425. Displacement command 425 represents the amount of absolute displacement to be applied to metering valve 105 to achieve flow 315 and pressure drop 335.

Inverse Valve Block

Figure 6:
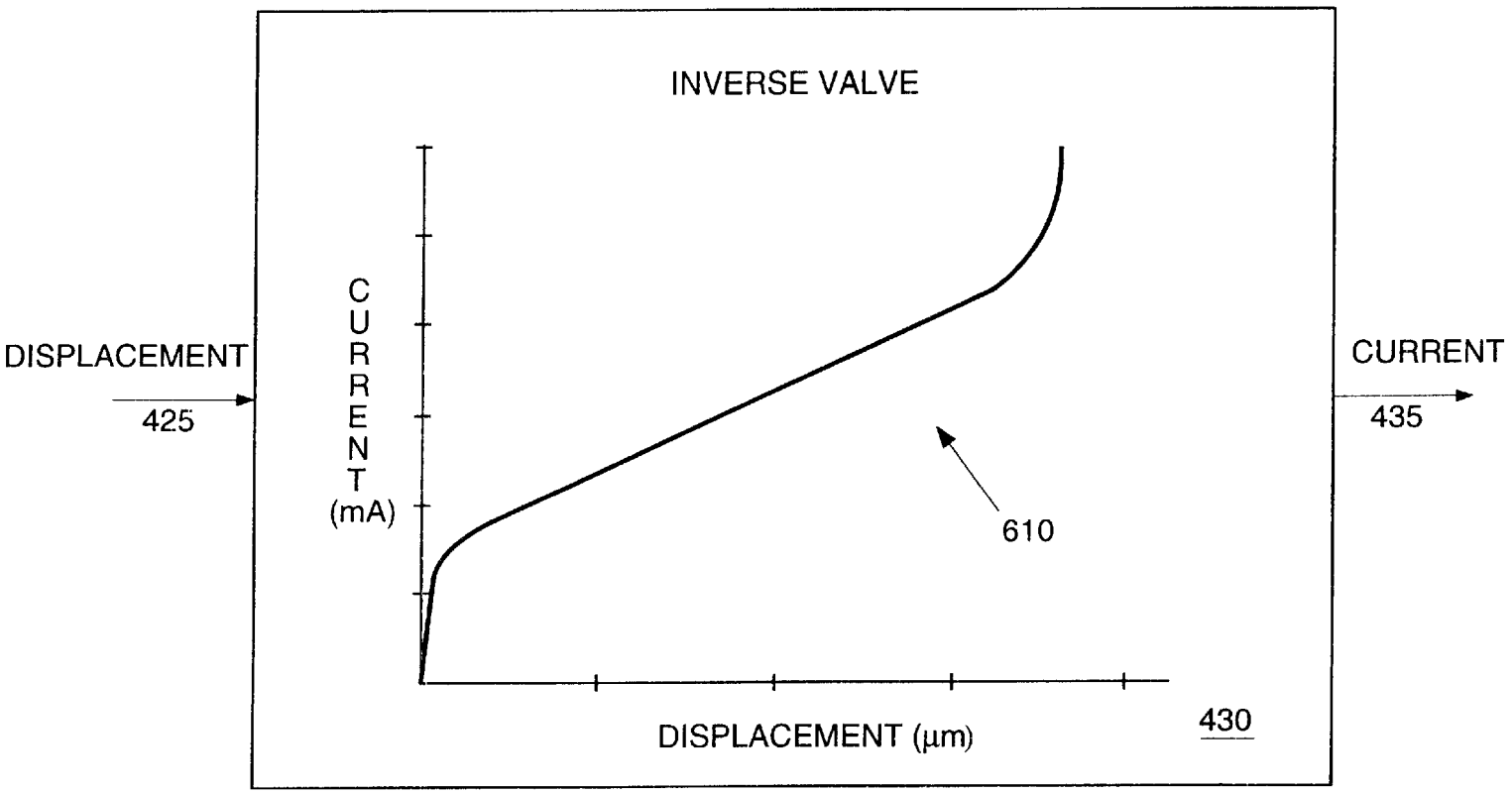
FIG. 6 illustrates a inverse valve portion of the single valve controller according to the present invention in further detail.

FIG. 6 illustrates the operation of inverse valve block 430 in further detail. Inverse valve block implements a conversion between displacement command 425 and actuation signal 345 to be applied to metering valve 105 to achieve that amount of displacement. As discussed above, in a preferred embodiment of the present invention, actuation signal 345 is a current signal. Inverse valve block 430 implements a conversion between displacement and current according to a displacement/current curve 610 as shown in FIG. 6. In one embodiment of the present invention, inverse valve block 430 implements displacement/current curve 610 as a look-up table wherein displacement command 425 provides an index to actuation signal 345. In another embodiment of the present invention, inverse valve block 430 approximates displacement/current curve 610 in the form of an equation. As would be apparent, displacement/current curve 610 changes for different types of metering valve 105. Furthermore, as would also be apparent, the type of curve that inverse valve block 430 implements will change for metering valves 105 requiring a different type of actuation (e.g., voltage instead of current, etc.).

Conclusion

While the invention has been particularly shown and described with reference to several preferred embodiments thereof, it will be understood by those skilled in the art that various changes in form and details may be made therein without departing from the spirit and scope of the invention as defined in the appended claims.

We claim:

1. A system for controlling a hydraulic circuit including a metering valve and a hydraulic device, the system comprising:

flow determining means for determining a desired flow through the metering valve based on a requested velocity;

pressure drop determining means for determining a desired pressure drop across the metering valve;

offset determining means for determining an offset associated with the metering valve;

displacement determining means for determining a displacement for the metering valve from said desired flow and said desired pressure drop and said offset; and actuating means for actuating the metering valve based on said displacement to control the hydraulic device in the hydraulic circuit.

2. The system of claim 1, wherein said offset is a nominal dead band offset associated with the metering valve.

3. The system of claim 1, wherein said offset is a zero flow offset associated with the metering valve.

4. The system of claim 1, wherein said offset is a zero displacement offset associated with the metering valve.

5. The system of claim 1, wherein said flow determining means determines said desired flow based on said requested velocity and an amount of flow available to the hydraulic circuit.

6. The system of claim 5, wherein said flow determining means comprises:

means for determining a maximum velocity of the hydraulic device based on said amount of flow available;

means for comparing said maximum velocity with said requested velocity; and means for determining said desired flow based on one of said maximum velocity and said requested velocity.

7. The system of claim 1, further comprising:

means for determining a inlet pressure on an inlet side of the metering valve;

means for determining a outlet pressure on an outlet side of the metering valve; and wherein said pressure drop determining means determines said desired pressure drop as a difference between said inlet pressure and said outlet pressure.

8. The system of claim 1, wherein said hydraulic device is a hydraulic cylinder, the system further comprising:

means for determining a head end pressure of said hydraulic cylinder; and means for determining a rod end pressure of said hydraulic cylinder; and wherein said pressure drop determining means determines said desired pressure drop based on at least one of said head end pressure and said rod end pressure.

9. The system of claim 8, further comprising:

means for determining a pump pressure of a pump supplying fluid to the hydraulic circuit; and wherein said pressure drop determining means determines said desired pressure drop based on at least one of said head end pressure, said rod end pressure, and said pump pressure.

10. The system of claim 1, wherein said actuating means comprises:

means for converting said displacement into an actuation signal based on characteristics of the metering valve.

11. A system for controlling a hydraulic circuit including a hydraulic device and a plurality of metering valves, the system comprising:

flow determining means for determining a desired flow through each of the plurality of metering valves based on a requested velocity and an amount of flow available to the hydraulic circuit;

pressure drop determining means for determining a desired pressure drop across each of the plurality of metering valves;

displacement determining means for determining a displacement for each of the plurality of metering valves based on said desired flow and said pressure drop associated with each of the plurality of metering valves; and actuating means for actuating each of the plurality of metering valves based on said displacement associated with each of the plurality of metering valves to control the hydraulic device in the hydraulic circuit.

12. The system of claim 11, wherein said flow determining means comprises:

means for determining a maximum velocity of the hydraulic device based on said amount of flow available;

means for comparing said maximum velocity with said requested velocity; and means for determining said desired flow based on one of said maximum velocity and said requested velocity.

13. The system of claim 11, further comprising:

means for determining a inlet pressure on an inlet side of each of the plurality of metering valves; and means for determining a outlet pressure on an outlet side of each of the plurality of metering valves, and wherein said pressure drop determining means determines said desired pressure drop as a difference between said inlet pressure and said outlet pressure for each of the plurality of metering valves.

14. The system of claim 11, wherein said hydraulic device is a hydraulic cylinder, the system further comprising:

means for determining a head end pressure of said hydraulic cylinder; and means for determining a rod end pressure of said hydraulic cylinder; and wherein said pressure drop determining means determines said desired pressure drop across each of the plurality of metering valves based on at least one of said head end pressure and said rod end pressure.

15. The system of claim 14, further comprising:

means for determining a pump pressure of a pump supplying fluid to the hydraulic circuit; and wherein said pressure drop determining means determines said desired pressure drop across each of the plurality of metering valves based on at least one of said head end pressure, said rod end pressure, and said pump pressure.

16. The system of claim 15, wherein said actuating means comprises:

means for converting said displacement into an actuation signal based on characteristics of each of the plurality of metering valves.

17. The system of claim 16, further comprising:

offset determining means for determining an offset associated with each of the plurality of metering valves; and wherein said displacement determining means determines said displacement for each of the plurality of metering valves based on said desired flow, said desired pressure drop, and said offset.

18. The system of claim 17, wherein said offset associated with at least one of the plurality of metering valves is a nominal dead band offset.

19. The system of claim 17, wherein said offset associated with at least one of the plurality of metering valves is a zero flow offset.

20. The system of claim 17, wherein said offset associated with at least one of the plurality of metering valves is a zero displacement offset.

21. A system for controlling a plurality of hydraulic circuits, each of the plurality of hydraulic circuit having a plurality of metering valves, the system comprising:

flow determining means for determining a desired flow through each of the plurality of metering valves in each of the plurality of hydraulic circuits based on a requested velocity and an amount of flow available to each of the plurality of hydraulic circuits;

pressure drop determining means for determining a desired pressure drop across each of the plurality of metering valves in each of the plurality of hydraulic circuits; and displacement determining means for determining a displacement for each of the plurality of metering valves in each of the plurality of hydraulic circuits based on said desired flow and said desired pressure drop associated with each of the plurality of metering valves in each of the plurality of hydraulic circuits.

22. A system for controlling a hydraulic circuit including an independent metering valve and a hydraulic cylinder, the independent metering valve including an input port, an output port, first and second control ports, first and second independently operable electrohydraulic metering valves disposed between the input port and the first and second control ports, and third and fourth independently operable electrohydraulic metering valves disposed between the output port and the first and second control ports, the system comprising:

a flow determinator that determines a desired flow through at least one of the first, second, third, and fourth metering valves based on a requested velocity;

a pressure drop determinator that determines a desired pressure drop across said at least one of the first, second, third, and fourth metering valves based on a pump pressure, a head pressure of the hydraulic cylinder, and a rod pressure of the hydraulic cylinder; and a displacement determinator that determines a displacement for said at least one of the first, second, third, and fourth metering valves based on said desired flow and said desired pressure drop.

23. The system of claim 22, further comprising:

an offset determinator that determines an offset associated with said at least one of the first, second, third, and fourth metering valves; and wherein said displacement determinator determines said displacement for said at least one of the first, second, third, and fourth metering valves based on said desired flow, said desired pressure drop, and said offset.

24. The system of claim 23, wherein said offset is a nominal dead band offset associated with said at least one of the first, second, third, and fourth metering valves.

25. The system of claim 23, wherein said offset is a zero flow offset associated with said at least one of the first, second, third, and fourth metering valves.

26. The system of claim 23, wherein said offset is a zero displacement offset associated with said at least one of the first, second, third, and fourth metering valves.

27. The system of claim 23, wherein said flow determinator determines said desired flow through said at least one of the first, second, third, and fourth metering valves based on said requested velocity and an amount of flow available to the hydraulic circuit.

28. The system of claim 27, wherein said flow determinator determines a maximum velocity of the hydraulic cylinder based on said amount of flow available, and determines said desired flow based on the lessor of said maximum velocity and said requested velocity.

29. The system of claim 22, further comprising:

means for determining a head end pressure of the hydraulic cylinder; and means for determining a rod end pressure of the hydraulic cylinder; and wherein said pressure drop determinator determines said desired pressure drop based on at least one of said head end pressure and said rod end pressure.

30. The system of claim 29, further comprising:

means for determining a pump pressure that supplies fluid to the hydraulic circuit, wherein said pressure drop determinator determines said desired pressure drop across said at least one of the first, second, third, and fourth metering valves based on at least one of said head end pressure, said rod end pressure, and said pump pressure.

31. The system of claim 22, wherein said displacement determinator determines said displacement for said at least one of the first, second, third, and fourth metering valves from said desired flow and said desired pressure drop, and converts said displacement into a current signal for said at least one of the first, second, third, and fourth metering valves.

* * * * *